US005940520A

United States Patent [19]

Endo

[11] Patent Number: 5,940,520

[45] Date of Patent: Aug. 17, 1999

[54] POWER CIRCUIT FOR CONDENSER MICROPHONE

[75] Inventor: Osamu Endo, Tachikawa, Japan

[73] Assignee: Kabushiki Kaisha Audio-Technica, Tokyo, Japan

[21] Appl. No.: 08/950,876

[22] Filed: Oct. 15, 1997

[30] Foreign Application Priority Data

Nov. 19, 1996 [JP] Japan ..... 8-323466

[51] Int. Cl.[6] ..... H04R 3/00

[52] U.S. Cl. ..... 381/111; 381/123

[58] Field of Search ..... 381/111, 123; 330/254, 278

[56] References Cited

U.S. PATENT DOCUMENTS 5,239,579 8/1993 Schuh ..... 381/111

5,377,273 12/1994 Sutton ..... 381/111

*Primary Examiner*—Minsun Oh Harvey

*Attorney, Agent, or Firm*—Welsh & Katz, Ltd.

[57] ABSTRACT

The present invention discloses a power circuit for a condenser microphone capable of automatically switching both internal power source and external power source without carrying out the switching operation of a switch. A positive side output line comprises a power switch for turning off the positive side output line to selectively connecting it to a ground side output line; a first diode connected with an input direction from the external power source being a forward direction between the power switch and an output terminal of the positive side output line; and a capacitor connected parallel with said power switch and said first diode so as to bypass them, a series circuit comprising the internal power source, a second diode and a load resistor with a direction from the ground side output line to the positive side output line being a forward direction being connected between a connection point of the power switch and the first diode and the ground side output line.

7 Claims, 3 Drawing Sheets

POWER CIRCUIT FOR CONDENSER MICROPHONE

FIELD OF THE INVENTION

The present invention relates to a power circuit for a condenser microphone capable of supplying an operating power from either internal power source (mounted power source) or external power source to a microphone unit.

DESCRIPTION OF THE PRIOR ART

The condenser microphone is provided with a microphone unit including diaphragms arranged opposedly at predetermined intervals and a fixed electrode, and is widely popularized irrespective of general public welfare or business because of high fidelity of sound and easy miniaturization thereof.

The microphone unit requires an electronic circuit for removing a voice electric signal according to a sound wave and a driving power source. The driving power source is roughly divided into a built-in type in which a power source is mounted on a microphone body and an external supply type. For the general public welfare, generally, the former is of a battery driving system, and the latter is of a plug-in power system in which power is supplied from apparatuses to be connected, for example, a tape recorder, a mini-disk recorder, a video cam coder, etc.

FIG. 3 shows the circuit construction of the plug-in power system. A power source 1 indicative of a positive voltage with respect to the ground is provided internally of apparatus to which a microphone is connected. An electric signal is obtained by a load resistor 2 provided between the power source 1 and a signal line of the microphone. This system has the merit for directly driving a microphone unit called a 2-terminal system. Reference numeral 3 designates a condenser for a DC cut.

On the other hand, in the built-in type, it can be applied to a plurality of microphone unit types such as a 2-terminal system shown in FIG. 4A, and a 3-terminal system shown in FIG. 4B, which are used according to the necessity of products. In the drawings, P designates a voice pickup portion comprising a diaphragm and a fixed electrode, and IC designates, for example, FET for impedance conversion. In the 2-terminal system, an output phase is inverted with respect to the output of the voice pickup, and in the 3-terminal system, either positive phase or reverse phase or both of an output phase is removed as an output.

In the case where both the built-in type and the plug-in power system can be applied, the 2-terminal system is employed. The common systems include the following two methods.

In the first common system, a power module E in which a battery is built in is necessary separately from a microphone body M, as shown in FIG. 5. When the plug-in power is used, the power module E is removed, and a plug of the microphone body M is connected directly to the apparatus, for example, such as a tape recorder in which the plug-in power is mounted.

In the second common system, as shown in FIG. 6, the microphone body is internally provided with a battery 1*a*, a load resistor 2*a* and a capacitor 3*a* for a DC cut, and either battery 1*a* or an external power source is selected by a switch 4.

That is, in the case where an internal battery is used, when the switch 4 is connected to a contact 4*a*, power is supplied to a microphone unit not shown through the load resistor 2 from the battery 1*a*, and a voice signal is output to an output terminal through the capacitor 3*a* from the microphone unit.

On the other hand, in the case where an external power is used, an external power source shown in FIG. 3 is connected to an output terminal, and the switch 4 is switched to a contact 4*b*. A contact 4*c* is a power-off contact.

However, these prior arts have the following drawbacks.

The first common system shown in FIG. 5 is effective for a tie pin type microphone, for example, whose microphone body M is extremely small. However, since a power module as a separate piece is necessary, an increase in cost cannot be avoided. Further, in this case, generally, the power switch is provided on the power module side, it is necessary to operate a power switch away from the microphone body M to cutoff a signal. Moreover, when the power module E is removed and the external power source is used, the signal of the microphone cannot be cutoff.

On the other hand, according to the second common system shown in FIG. 6, since the power switch is provided on the microphone body, the operation beside the switch can be made. However, it is necessary to switch the power switch according to the kind of power sources by a user himself before use. It is considered that the sound cannot be absorbed instantly. That is, in the case where when the internal battery is intended to be use, the power switch is switched to the external power source, for example, it is likely that the state not capable of absorbing sound till such switching continues for a while.

Further, in the case where the external power source cannot be used for some trouble, the absorption of sound discontinues till the power switch is switched to the internal power source side. Further, for the power switch, the 3-contact switching system of an external power side contact, an internal battery side contact and a power off contact is used, and therefore, the microphone body becomes large-scaled to increase the cost.

SUMMARY OF THE INVENTION

It is an object of the present invention to provide a power circuit for a condenser microphone which can automatically switch both an internal power source and an external power source, without carrying out troublesome switching operation of a switch, and which can further miniaturize a microphone body and can reduce the cost.

A power circuit for a condenser microphone according to one embodiment of the present invention comprises a microphone unit; either internal power source or external power source for supplying a DC operating power through a positive side output line and a ground side output line of the microphone unit; said positive side output line comprising a power switch for turning off said positive side output line to selectively connecting it to said ground side output line; a first diode connected with an input direction of said external power source from said output terminal being a forward direction between said power switch and an output terminal of said positive side output line; a capacitor connected parallel with said power switch and said first diode so as to bypass them; a series circuit connected between a connection point of said power switch and said first diode and said ground side output line, said series circuit comprising a second diode and a load resistor with a direction from said internal power source and said ground side output line to said positive side output line being a forward direction; and means for switching a drive power source driven by an external power source from an external apparatus when in a plug-in power.

In a further embodiment, the power switch is removed from the above-described embodiment, and the internal power source and the plug-in power from the external apparatus are automatically switched.

With the constitution described above, the internal battery and the external power source (plug-in power) can be used in common.

Even if the internal battery and the external power source are used in common as described above, the power switching can be automatically carried out. Therefore, no burden in operation such as switching is imposed on a user as in prior art, and no interruption of absorption of sound occurs as power switching takes place. In this case, generally, the internal battery is higher in voltage than the external power source so that the power switching is carried out first from the external power source, thus preventing wasteful consumption of the battery.

Further, since the power switch is provided on the microphone body, the switch operation can be done at hand. When the power is off, the output line of the voice signal is grounded in an AC manner. Therefore, on the apparatus side to which the microphone is connected, its input is short-circuited in an AC manner, and even if the volume is increased, no noise occurs.

Further, the power switch may be of a 2-contact switching system, which is small and inexpensive. Accordingly, it is possible to further miniaturize the microphone itself, reducing the cost. As the case may be, even if the power switch is omitted, the internal battery and the external power source can be automatically switched.

DESCRIPTION OF THE PREFERRED EMBODIMENTS

Figure 4A:
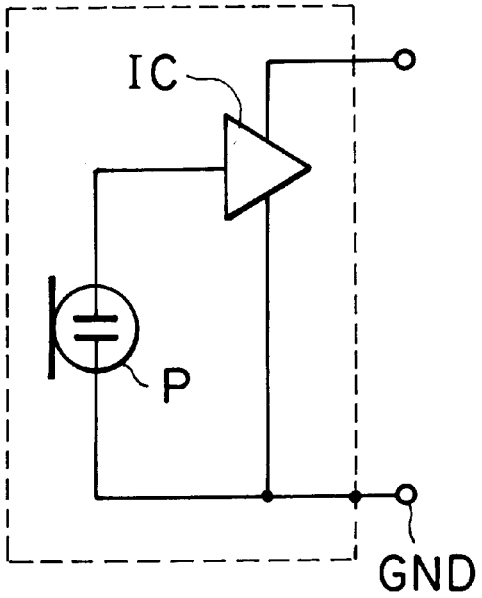
FIG. 4 is circuit views of a 2-terminal system and a 3-terminal system of a microphone unit in a condenser microphone.
Figure 4B:
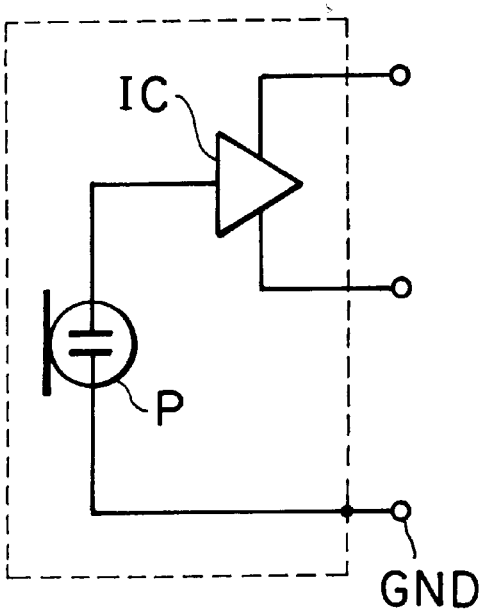
Figure 5:
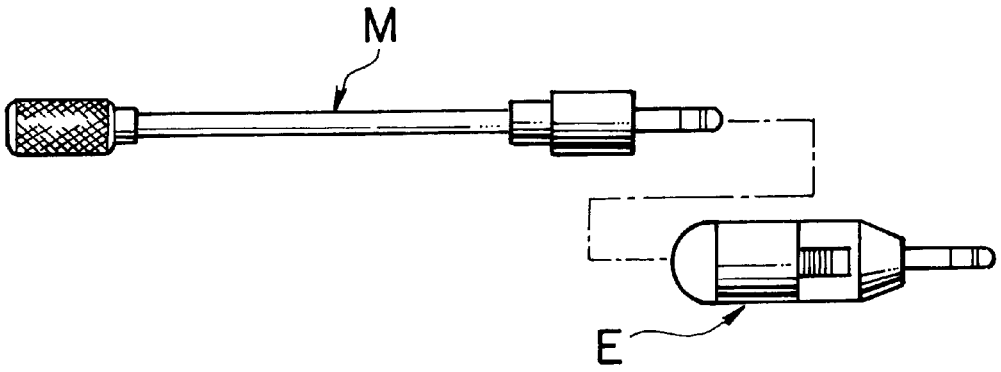
FIG. 5 PRIOR ART
FIG. 5 is an explanatory view showing a first conventional example of a common system of an internal power source and an external power source.
Figure 6:
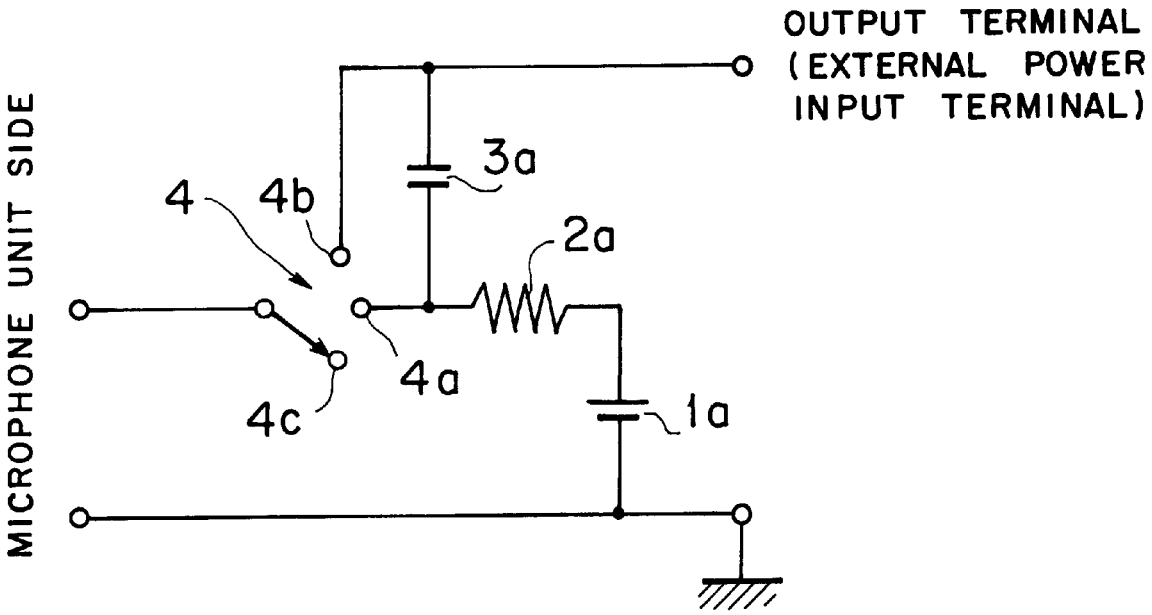
FIG. 6 PRIOR ART
FIG. 6 is an explanatory view showing a second conventional example of a common system of an internal power source and an external power source.

The embodiments of the present invention will be explained hereinafter with reference to the drawings. It is noted that in the ensuing description, the microphone unit includes a voice pickup portion P comprising a diaphragm and a fixed electrode, and an IC formed of, for example, FET as an impedance converter as shown in FIGS. 4 and 5.

First, a first embodiment of the present invention will be described. A power circuit 10 is provided, within a microphone body, between a positive side output line 11 derived from the microphone unit side and a ground side output line 12. Connecting terminals with respect to an external apparatus (for example, a tape recorder) of the positive side output line 11 and the ground side output line 12 are output terminals 11*a* and 12*a*.

According to the power circuit 10, the positive side output line 11 is provided with a power switch 13 for turning off the positive side output line 1 to selectively connect it to the ground side output line 12. The power switch 13 used here is of the 2-contact switching type, and a common contact 13*a* thereof is provided on the microphone unit side of the positive side output line 11. On the other hand, one switching contact 13*b* and the other switching contact 13*c* are provided on the output terminal 11*a* side and the ground side output line 12 side, respectively.

A first diode 14 connected with an input direction of the external power source from the output terminal 11*a* being a forward direction is provided between the power switch 13 and the output terminal 11*a* of the positive side output line 11, and the positive side output line 11 is provided with a capacitor 15 connected parallel with the power switch 13 and the first diode 14 so as to bias them. The capacitor 15 is for DC cut and of no-polarity.

Between the connecting point of the power switch 13 and the first diode 14 and the ground side output line 12 is connected a series circuit comprising a battery 16 as an internal power source having a positive voltage with respect to the ground side output line 12, a second diode 17 with a direction from the ground side output line 12 to the positive side output line 11 being a forward direction, and a load resistor 18.

With the above-described construction, when the power switch 13 is switched to the switching contact 13*b* side, a sound absorbing state with power turned on is obtained. That is, in case of non-plug-in power, the operating power is supplied from the battery 16 to the microphone unit through the second diode 17 and the load resistor 18. The voice signal output from the microphone unit side appears in the output terminal 11*a* through the capacitor 15 and is fed to the microphone amplifier side of the external apparatus such as a tape recorder (not shown)

A flow of current from the battery 16 to the output terminal 11*a* of the positive side output line 11 is obstructed by the first diode 14. At that time, the first diode 14 assumes the reverse bias state so that the internal impedance rises, but the voice signal can be removed without problem since the capacitor 15 is connected parallel with the first diode 14.

Figure 3:
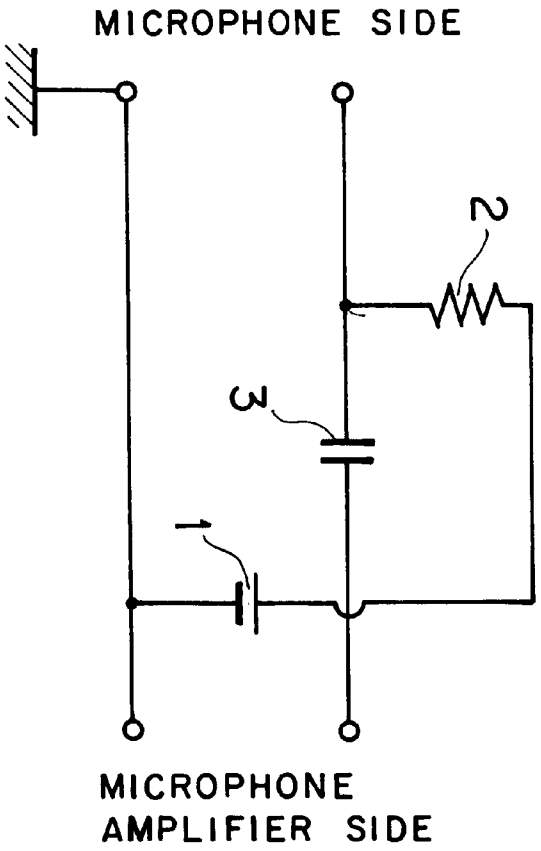
FIG. 3 is a circuit view showing an external power source applied to a plug-in power system.

On the other hand, when in the plug-in power, the external power (for example, see external power in FIG. 3) from the external apparatus is supplied from the output terminal 11*a* to the microphone unit side through the first diode 14, and the voice signal output from the microphone unit side appears in the output terminal 11*a* through the capacitor 15.

The flow-in from the external power source into the battery 16 side is obstructed by the second diode, but with respect to the microphone unit, the external power source or the battery 16 whichever higher in power voltage takes precedence. Generally, since the power voltage of the plug-in power is set higher than that of the battery 16, wasteful consumption of battery is prevented.

On the other hand, the microphone is turned off by connecting the power switch 13 to the switching contact 13*c* side. That is, since the power circuit 10 itself is turned off, even at the time of plug-in power, the microphone is turned off, and the consumption of the battery 16 is prevented.

Further, the positive side output line 11 of the microphone unit is connected to the ground side by switching the power switch 13 to the switching contact 13*c* side. With this, the input to the apparatus connected to the output terminals 11*a*, 12*a* is short-circuited in an AC manner. Accordingly, even if the volume of the apparatus is increased, no noise occurs.

Figure 1:
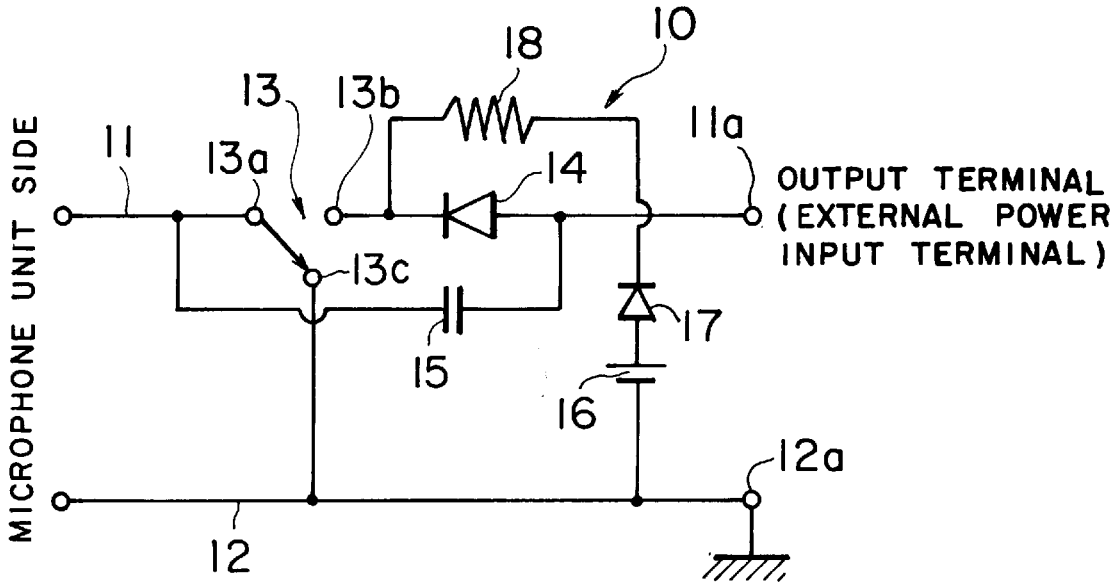
FIG. 1 is a circuit view showing a first embodiment of the present invention.
Figure 2:
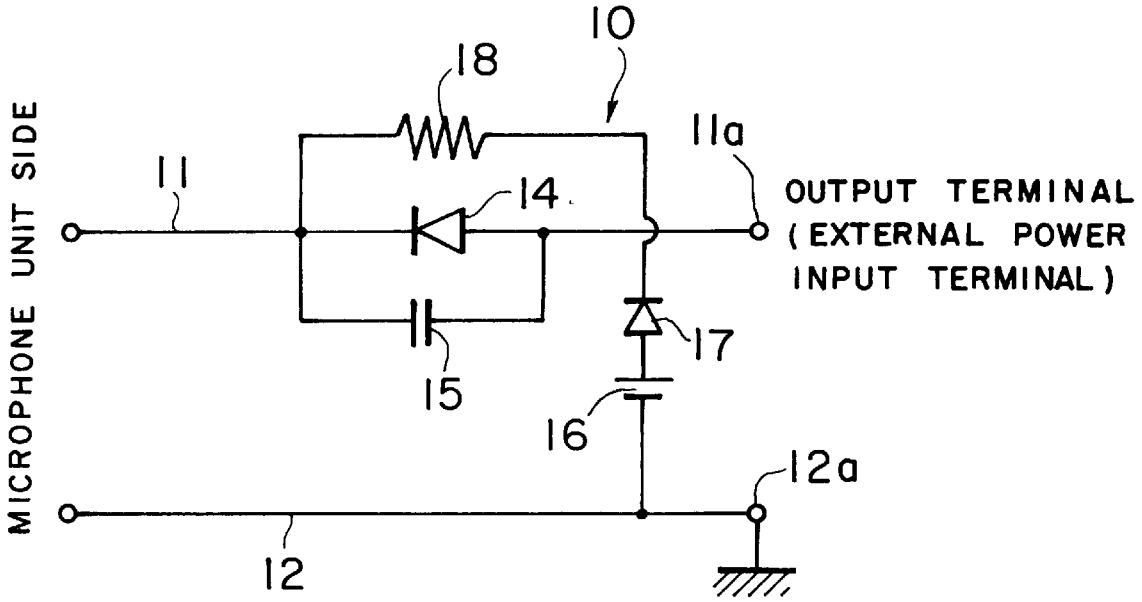
FIG. 2 is a circuit view showing a second embodiment of the present invention.

A second embodiment of the present invention will now be explained with reference to FIG. 2. In the second embodiment, the power switch 13 is removed from the aforementioned first embodiment. In the second embodiment, the battery 16 and the plug-in power from the external apparatus are automatically switched.

The second embodiment is exclusively applied to the microphone for business use. When other than the plug-in power, when the battery 16 is turned on, the microphone assumes the on-state, and the microphone is turned off by removing the battery 16. Accordingly, in the second embodiment, taking in and out of the battery 16 acts as the power switch.

I claim:

1. A power circuit for a condenser microphone comprising:

either internal power source or external power source for supplying a DC operating power through a positive side output line and a ground side output line of a microphone unit;

said positive side output line comprising a power switch for turning off said positive side output line to selectively connecting it to said ground side output line;

a first diode connected with an input direction of said external power source from said output terminal being a forward direction between said power switch and an output terminal of said positive side output line;

a capacitor connected parallel with said power switch and said first diode so as to bypass them;

a series circuit connected between a connection point of said power switch and said first diode and said ground side output line, said series circuit comprising a second diode and a load resistor with a direction from said internal power source and said ground side output line to said positive side output line being a forward direction; and means for switching a drive power source driven by an external power source from an external apparatus when in a plug-in power.

2. The power circuit for a condenser microphone according to claim 1, wherein said power switch is of a 2-contact switching type, a common contact thereof being connected to said microphone unit of said positive side output line, and switching contacts are provided on the output terminal side of said positive side output line and on said ground side output line side.

3. The power circuit for a condenser microphone according to claim 1, wherein said capacitor is a non-polarity capacitor.

4. The power circuit for a condenser microphone according to claim 1, wherein said internal power source is a battery.

5. A power circuit for a condenser microphone comprising:

a microphone unit; either internal power source or external power source for supplying a DC operating power through a positive side output line and a ground side output line of said microphone unit; a first diode connected with an input direction of said external power source from an output terminal of said positive side output line being a forward direction; a capacitor connected parallel with said power switch and said first diode so as to bypass them; a series circuit connected between a cathode side of said first diode and said ground side output line, said series circuit comprising said internal power source, a second diode and a load resistor with a direction from said ground side output line to said positive side output line being a forward direction; and means for switching a drive power source driven by an external power source from an external apparatus when in a plug-in power.

6. The power circuit for a condenser microphone according to claim 5, wherein said capacitor is a non-polarity capacitor.

7. The power circuit for a condenser microphone according to claim 5, wherein said internal power source is a battery.

* * * * *